US006257954B1

(12) United States Patent
Ng et al.

(10) Patent No.: US 6,257,954 B1
(45) Date of Patent: Jul. 10, 2001

(54) APPARATUS AND PROCESS FOR HIGH TEMPERATURE WAFER EDGE POLISHING

(75) Inventors: Kan-Yin Ng, Maryland Heights; Robert J. Walsh, Ballwin; Henry Erk, St. Louis; Dennis Buese, O'Fallon, all of MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

(21) Appl. No.: 09/511,030

(22) Filed: Feb. 23, 2000

(51) Int. Cl.[7] ..... B24B 49/00; B24B 51/00
(52) U.S. Cl. ..... 451/7; 451/43; 451/44
(58) Field of Search ..... 451/6, 7, 8, 41, 451/42, 43, 44, 53, 177, 178

(56) References Cited

U.S. PATENT DOCUMENTS

| | | | |
|---|---|---|---|
| 4,276,114 | 6/1981 | Takano et al. | 156/645 |
| 5,094,037 | 3/1992 | Hakomori et al. | 51/165.77 |
| 5,097,630 | 3/1992 | Maeda et al. | 51/50 |
| 5,117,590 | 6/1992 | Kudo et al. | 51/283 |
| 5,274,959 | 1/1994 | Dyer et al. | 51/103 |
| 5,547,415 | 8/1996 | Hasegawa et al. | 451/44 |
| 5,595,522 | 1/1997 | Simpson et al. | 451/5 |
| 5,643,056 | 7/1997 | Hirose et al. | 451/41 |
| 5,643,060 | 7/1997 | Sandhu et al. | 451/285 |
| 5,658,189 | 8/1997 | Kagamida | 451/66 |
| 5,842,909 | 12/1998 | Sandhu et al. | 451/7 |

*Primary Examiner*—Derris H. Banks
(74) *Attorney, Agent, or Firm*—Senniger, Powers, Leavitt & Roedel

(57) ABSTRACT

An apparatus and process for chemical-mechanical polishing an edge of a semiconductor wafer using a heated polishing pad and a heated liquid chemical slurry. The apparatus includes a rotatable drum having a cylindric outer surface, a heatable mat positioned around the outer surface of the drum, and a polishing pad in generally parallel arrangement with the mat. A wafer holder, a container of liquid slurry, and a slurry delivery system are also included. The process includes the steps of heating a liquid slurry to an elevated temperature and applying heat to the polishing pad from an underside of the polishing pad to elevate the temperature of the polishing pad. A peripheral edge of a semiconductor wafer is engaged against a polishing side of the polishing pad, and a relative motion is effected between the wafer and the pad while simultaneously dispensing the heated slurry onto a region where the edge of the wafer engages the pad.

23 Claims, 2 Drawing Sheets

APPARATUS AND PROCESS FOR HIGH TEMPERATURE WAFER EDGE POLISHING

BACKGROUND OF THE INVENTION

This invention relates generally to semiconductor wafer polishing, and in particular to an apparatus and process for polishing peripheral edges of wafers at elevated temperature for improved throughput.

Semiconductor wafers are generally prepared from a single crystal ingot, such as a silicon ingot, which is sliced into individual wafers. Each wafer is subjected to a number of processing operations to facilitate the installation of integrated circuit devices and to improve their yield, performance, and reliability. Typically, these operations reduce the thickness of the wafer and remove damage caused by the slicing operation. Chemical-mechanical polishing of semiconductor wafers is one of these operations. It generally involves rubbing a wafer with a polishing pad, such as a polyurethane impregnated polyester felt, while dispensing a polishing solution, or slurry. The slurry contains an abrasive and chemicals, such as a colloidal silica and an alkaline etchant, so that both mechanical action and chemical reaction contribute to the removal of material. The polishing process produces surfaces that are flat, highly reflective, and damage-free.

It is crucial that each wafer undergo polishing not only on at least one of its flat, facial surfaces but also along its peripheral edge. Wafer edges frequently contain microcracks and chip damage from the slicing operation and from a grinding operation, or profiling, along the edges that forms a selected edge profile shape. During handling and processing, edges often receive impact forces or high local stresses that cause additional fractures, chips, or roughness. If left in place, these imperfections become local stress points for the nucleation of damage to the lattice of the crystal structure. They significantly increase the likelihood of subsequent growth of slips and dislocations that can ruin the wafer. Further, edge roughness tends to facilitate adherence of impurities, such as dust particles and inorganic anions. These impurities can diffuse from wafer edges to facial surfaces and detrimentally contaminate wafers. Accordingly, edges are polished to remove imperfections or reduce their size.

One type of machine that is used for polishing semiconductor wafer edges is shown in U.S. Pat. No. 5,094,037, which is hereby incorporated by reference. The machine includes at least one rotatable wafer holder that presses the edge of the wafer against a rotating cylindric drum. The drum is covered with a polishing pad so that as the drum rotates, the polishing pad rubs against the edge of the wafer. The drum oscillates vertically as it rotates, evenly exposing all portions of the polishing pad against the wafer edge. Simultaneously, the wafer holder rotates the wafer in a direction opposite to that of the drum, thereby increasing the relative speed between the wafer edge and the polishing pad. Slurry may be prepared in a container having an agitator for mixing the slurry and maintaining a preselected pH level. The slurry is dispensed at a controllable flowrate onto the polishing pad at a location where the wafer engages the pad.

A limitation to the chemical mechanical polishing process, including machines of this type, is that polishing requires a substantial amount of time. A typical duration for the chemical reaction and mechanical action to effect an acceptable level of smoothness along a first side or bevel of an edge is 85 seconds. That time duration must then be repeated to polish a second, opposite side of the edge. To shorten the time, polishing has been conducted at elevated temperatures which accelerates the chemical reaction between the slurry and the wafer. However, there have been difficulties implementing high temperature edge polishing and there are no machines of the type described above that permit it. Throughput with edge polishing machines is typically limited to between 32 and 42 wafers per hour, and the edge polishing process is a hindrance to efficient processing of wafers.

SUMMARY OF THE INVENTION

Among the several objects and features of the present invention may be noted the provision of an apparatus and process for polishing edges of semiconductor wafers that shorten the time needed to conduct edge polishing; the provision of such an apparatus and process which increase manufacturing throughput of semiconductor wafers; the provision of such an apparatus and process for polishing at a precisely controlled elevated temperature; the provision of such an apparatus and process which efficiently and thoroughly remove microcracks in the edges of the wafers; and the provision of an apparatus and process that are efficient and economical.

In general, an apparatus of the present invention for polishing edges of silicon wafers at elevated temperature for high throughput comprises a rotatable drum having a cylindric outer surface, a heatable mat positioned around the outer surface of the drum, and a polishing pad in generally parallel arrangement with the mat on the drum. The pad has an outwardly facing polishing surface around the drum. A wafer holder is disposed relative to the polishing pad and adapted to hold a wafer so that a peripheral edge of the wafer is held in pressed engagement against the polishing pad. The apparatus includes a container of liquid slurry and a slurry delivery system for delivering slurry from the container to a location generally where the wafer is held against the pad.

In another aspect, an improvement of the present invention is for a wafer edge polishing apparatus of a type having a drum that is generally cylindric and rotatable with a polishing pad mounted thereon and forming an outermost surface around a circumference of the drum. A wafer holder positions a peripheral edge of a wafer in engagement against the polishing pad. The improvement of the present invention comprises a heatable mat positioned around the circumference of the drum between the drum and the polishing pad for applying heat to the polishing pad.

A process according to the present invention for chemical-mechanical polishing an edge of a semiconductor wafer using a liquid chemical slurry and a polishing pad, the pad having a polishing side and an underside, comprises the steps of heating the liquid slurry to an elevated temperature and applying heat to the polishing pad from the underside of the polishing pad to elevate the temperature of the polishing pad. A peripheral edge of a semiconductor wafer is engaged against the polishing side of the polishing pad. A relative motion is effected between the wafer and the pad while simultaneously dispensing the heated slurry generally onto a region where the edge of the wafer engages the pad, thereby polishing the edge while both the pad and the slurry are at elevated temperatures.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
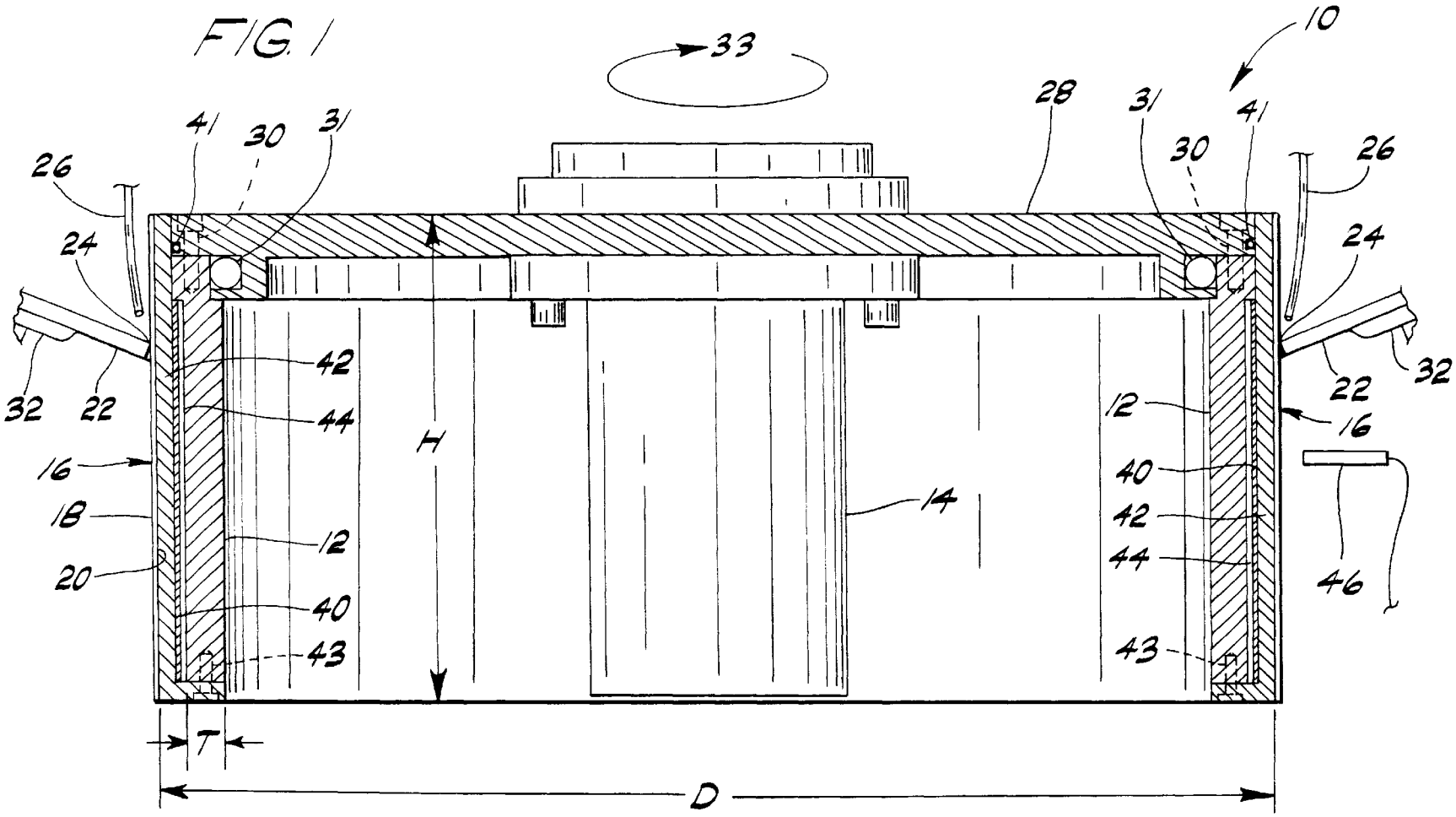
FIG. 1 is a schematic, sectional view of a machine for polishing peripheral edges of semiconductor wafers.

Referring now to the drawings and in particular to FIG. 1, an apparatus for polishing peripheral edges of semiconductor wafers at elevated temperature is indicated generally at 10. The apparatus 10 is part of an edge polishing machine of the type described in U.S. Pat. No. 5,094,037. The machine is a model EP-200-IVSN manufactured by SpeedFam-IPEC, having offices in Chandler, Ariz. The machine has a cylindric drum 12 that is rotatable about a central axle 14. A polishing pad 16 is attached to the drum 12 and rotates with the drum. The pad 16 has a polishing side 18 that faces outwardly and an underside 20. At least one wafer 22 is held with an edge 24 engaged against the polishing pad 16. As the drum 12 rotates, the polishing pad 16 rubs against the edge 24 to remove material and smooth the edge. A liquid polishing slurry is dispensed from tubes 26 onto the polishing pad 16 at a location generally where the edge 24 engages the pad.

A horizontal upper cover plate 28 is connected to the drum 12 by bolt fasteners 30, and it rotates together with the drum. An O-ring seal 31 is positioned between the cover plate and the drum. A motor (not shown) controllably rotates the drum 12 as indicated by Arrow 33. As it rotates, an internal mechanism causes the drum to oscillate in a vertical direction. Therefore, most of an entire vertical extent of the polishing side 18 of the polishing pad 16 is exposed to the wafer 22, which is held at fixed elevation. In the preferred embodiment, the drum 12 is sized so that the apparatus has a diameter D of about 216 mm and a height H of about 95 mm, with the drum 12 having a thickness T of about 20 mm. The drum is made of a suitable material that is durable and chemically resistant, such as a rigid polyamide or nylon. Other sizes and material constructions do not depart from the scope of this invention.

At least two wafer holders 32 are positioned adjacent to the drum 12 for pressing wafer edges 24 against the pad 16 as the drum rotates. Each holder 32 includes a conventional vacuum chuck for holding the wafer 22 and is controllably rotatable about a center of the wafer. Each wafer holder 32 is oriented at a selectable angle with respect to the drum 12 in order to polish at a chosen bevel inclination. Typically, this angle is about 45°, and it cannot be changed during a polishing operation. When the drum rotates, each wafer holder 32 simultaneously rotates its wafer 22 in a direction opposite to that of the drum, thereby increasing a relative rubbing speed between the wafer edge 24 and the polishing pad 16 to accelerate the mechanical polishing.

The construction of the apparatus 10 described to this point is conventional and well understood by those of ordinary skill in the art. Importantly, the apparatus of the present invention is particularly constructed for warming the polishing pad 16 to an elevated temperature to accelerate the chemical reaction between the slurry and the wafer 22. A heatable mat 40 is located beneath the polishing pad 16, in close proximity to the underside 20, although as described below for the preferred embodiment, the mat is not in direct contact with the polishing pad. An entire surface area of the mat 40 is slightly less than an entire surface area of the polishing pad 16. Portions of the pad 16 which do not have the mat 40 underneath, including an upper portion and an extreme lower portion, generally do not contact wafers. The mat 40 is controlled to elevate and preferably uniformly maintain the temperature of the polishing side 18 of the polishing pad to within a range between about 27° and 50° C. In practice, 38° C. has been shown to be an effective temperature.

The mat 40 is a flexible and thin electrical resistance silicone rubber heater that provides uniform heat distribution across the surface area of the mat. In practice, a mat that has been useful is a 250-1000-W model made by Watlow Electric Manufacturing Company of St. Louis, Mo. Electrical power supply wires for the heatable mat 40 are arranged to extend from the drum 12 at a central position where the wires will not tangle or otherwise interfere with rotation of the drum. Although in the preferred embodiment the heatable mat 40 provides heat energy to the polishing pad 16, any alternate heat source that internally warms the polishing pad does not depart from the scope of this invention.

The heatable mat 40 is configured in a tubular arrangement and positioned between the drum 12 and the polishing pad 16. A cylindrical shell 42 of a suitable rigid and thermally conductive material is included between the mat and the polishing pad. An O-ring seal 41 is positioned between the shell and the upper cover plate 28. The shell 42 provides a firm support for the mat 40 and polishing pad 16 and permits heat conduction. In the preferred embodiment, the shell comprises a metal such as aluminum, between 2 and 3 mm thick, that is attached to the drum by bolt fasteners 43. The mat 40 and pad 16 are attached along opposite sides of the metal shell 42 with a suitable adhesive or fastener. Heat from the mat 40 is conducted through the metal shell 42 to the underside 20 of the polishing pad.

An alternate embodiment (not shown) has no shell, with the heatable mat being in direct engagement along the underside of the polishing pad, and it does not depart from the scope of this invention.

As seen in FIG. 1, the mat 40 is positioned to be in radially spaced relationship from the drum 12 so that an air gap 44 is formed therebetween. The air gap 44 functions as an insulator, preventing direct contact between the heatable mat 40 and the drum 12 so that radiative, but no conductive, heat transfer can occur from the mat to the drum. In other words, heat will flow away from the mat 40 primarily in a radially outward direction (toward the polishing pad 16), where it accelerates polishing, and not inwardly where it could begin to soften or melt the nylon drum 12. Temperature of the nylon drum is maintained well below its melting temperature (above about 70° C.). In the preferred embodiment, the air gap 44 is about a 1 mm radial spacing between an outer surface of the drum and the heatable mat. Other spacings do not depart from the scope of this invention. If the drum 12 were constructed of a material with a relatively high melting point, the spacing could be zero, with no air gap between the mat and the drum.

A thermal sensor 46 is positioned near to the polishing side 18 of the polishing pad 16 for monitoring the surface temperature of the polishing pad and for making responsive adjustments to the operation of the mat 40. In the preferred embodiment, the sensor 46 is a conventional radiative type optical pyrometer that is positioned facing the polishing side 18 of the pad at a distance between about 25 and 50 mm from the pad. As the drum 12 oscillates vertically as it rotates, most portions of the polishing pad 16 pass directly in front of the sensor 46 so that the measured temperature is an overall area-weighted average. The sensor 46 is attached to a controller (not shown) that adjusts the electrical energy supplied to the mat 40 in response to the monitored temperature. In an alternate embodiment (not shown), the thermal sensor 46 is a thermocouple or other in-situ temperature sensor at a location in direct physical contact with the polishing pad 16.

Figure 2:
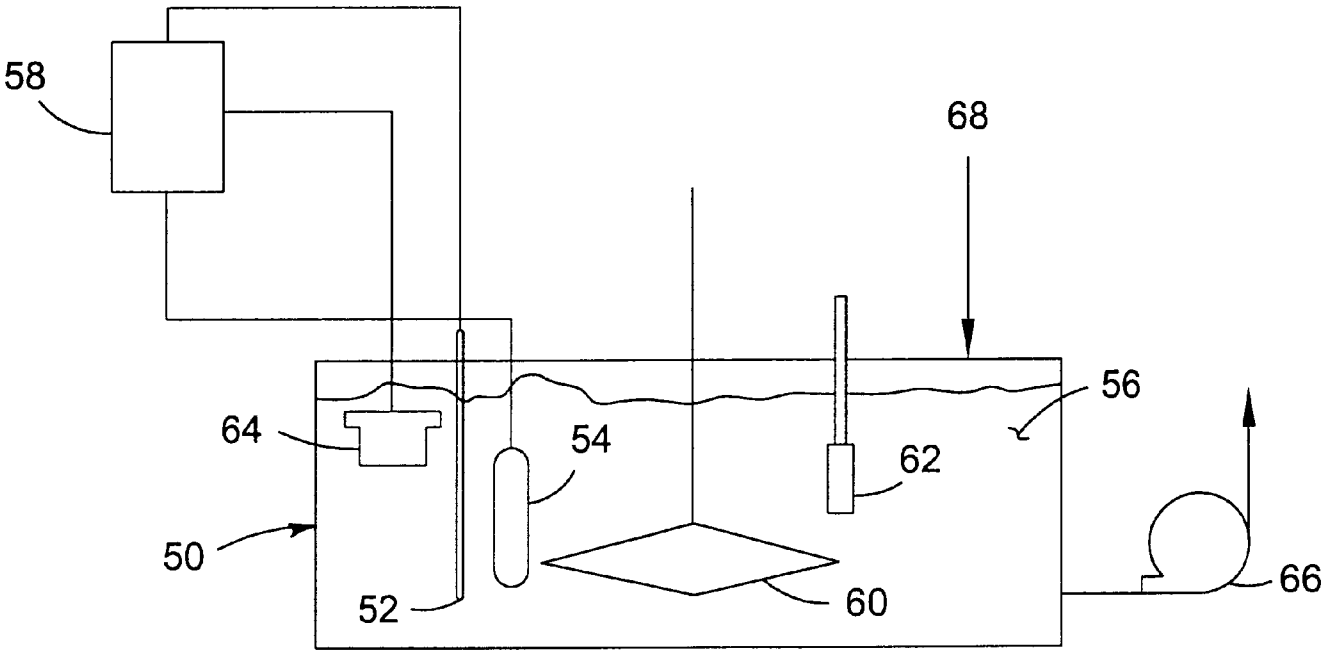
FIG.2 is a schematic, sectional view of a system for preparing polishing slurry.

Referring now to FIG. 2, a container for preparing slurry at an elevated temperature is indicated generally at 50. Importantly, the container has an immersed temperature sensor 52 and immersed heating element 54 for keeping slurry 56 at an elevated temperature. A controller 58 adjusts electrical energy supplied to the heating element 54 in response to the monitored temperature from the sensor 52 in order to achieve a desired slurry temperature.

The container 50 and the associated controller 58 include systems well known to those of ordinary skill in the art for maintaining the pH and quantity of slurry. The container includes an agitator 60 for keeping the slurry well mixed. The container has a pH meter 62 for sensing the acidity or alkalinity of the slurry 56. If the pH falls outside of an acceptable range (typically between 10.5 and 11.0 for maximum material removal), the controller sets off an alarm to indicate to an operator the need for service. Specifically, the slurry 56 may need addition of potassium hydroxide (KOH) or water ($H_2O$) to return the slurry to the desired pH level. The container 50 has a level controller 64 for sensing whether the quantity of slurry falls below an acceptable amount. If so, the controller 58 sets off an alarm to indicate to an operator the need for service.

Although a range of temperatures are envisioned that will increase the speed of the chemical reaction between the slurry and the semiconductor material to improve throughput, a typical preferred temperature for the slurry is about 45° C. Above that temperature, pH more readily fluctuates and can be difficult to control.

A slurry delivery system comprises a pump 66 to transport slurry 56 from the container 50 to the tubes 26 for dispensing at the locations where wafer edges 24 engage the polishing pad 16. The container 50 is located near the drum 12 and preferably underneath it so that the slurry drips down and is re-captured within the container for re-cycling as indicated by arrow 68.

In operation, the apparatus 10 is used in a process for chemical-mechanical polishing the edge 24 of the semiconductor wafer 22 while both the polishing pad 16 and the slurry 56 are at elevated temperatures. The thin, cylindrical shell 42 is placed around the circumference of the rotatable drum 12. The polishing pad 16 is attached on an outer side of the shell, and the heatable mat 40 is attached in parallel arrangement on an opposite, inner side of the shell. The shell and mat are positioned so that the air gap 44 is maintained between the drum and the mat as an insulator.

The slurry 56 is heated in the container 50 with the heating elements 54 under control of the controller 58 so that it reaches a predetermined temperature, such as 45° C. The agitator 60 keeps the temperature uniform in the container and the pH meter 62 monitors the acidity or alkalinity of the slurry to ensure it is maintained within a desired range.

Heat is applied to the polishing pad 16 from the underside 20 to elevate the temperature of the polishing pad. Electrical energy is supplied to the heatable mat 40, and the heat is conducted through the thin metallic shell 42 and warms the polishing pad so that the polishing side 18 is at a predetermined temperature in the range between about 27° and 50° C., and most preferably at about 38° C. At least one wafer 22 is placed in a wafer holder 32 so that the edge 24 engages the polishing side of the polishing pad. The drum 12 is rotated about its central axle 14 to effect a relative motion between the wafer 22 and the pad 16 while simultaneously dispensing the heated slurry 56 onto the locations where the edge of the wafer engages the pad. The wafer holder rotates the wafer about its center in a direction opposite to that of the drum to increase the relative rubbing speed between the pad and the wafer. One side of the edge 24 is polished at the desired bevel inclination. If desired, the wafer is subsequently moved to the second wafer holder to polish a second side of the edge of the wafer.

Because the polishing pad 16 is at an elevated temperature, the chemical reaction between the slurry and the wafer is accelerated. Also, because the slurry 56 is at an elevated temperature, the speed of reaction is further increased. In practice, results have demonstrated that the typical time needed for the chemical reaction and mechanical action effect an acceptable level of smoothness along a first side of a wafer edge has been reduced from the previous 85 seconds to about 52 seconds. These times will vary depending upon the specific temperatures, materials, and rubbing speeds. Throughput using the process of the present invention has been improved as much as 30%.

Although it is preferable to heat both the polishing pad 16 and the slurry 56 to elevated temperatures, a process may be followed where either one is heated, while the other is maintained at room temperature. The beneficial acceleration of polishing, however, will be lower than that of the preferred embodiment.

In view of the above, it will be seen that the several objects of the invention are achieved and other advantageous results obtained.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An apparatus for polishing edges of silicon wafers at elevated temperature for high throughput, the apparatus comprising:

a rotatable drum having a cylindric outer surface;

a heatable mat positioned around the outer surface of the drum;

a polishing pad in generally parallel arrangement with the mat on the drum, the pad having an outwardly facing polishing surface around the drum;

a wafer holder, the holder being disposed relative to the polishing pad and adapted to hold a wafer so that a peripheral edge of the wafer is held in pressed engagement against the polishing pad;

a container of liquid slurry; and a slurry delivery system for delivering slurry from the container to a location generally where the wafer is held against the pad.

2. An apparatus as set forth in claim 1 further comprising a rigid shell positioned between the heatable mat and the polishing pad.

3. An apparatus as set forth in claim 2 wherein the rigid shell is formed of a thermally conductive material.

4. An apparatus as set forth in claim 2 further comprising an insulator between the drum and the heatable mat.

5. An apparatus as set forth in claim 4 wherein the insulator comprises an air gap defined by radial spacing of the heatable mat from an outer surface of the drum.

6. An apparatus as set forth in claim 1 further comprising an insulator between the drum and the heatable mat.

7. An apparatus as set forth in claim 6 wherein the insulator comprises an air gap defined by radial spacing of the heatable mat from an outer surface of the drum.

8. An apparatus as set forth in claim 1 further comprising a temperature sensor for monitoring the temperature of the polishing pad.

9. An apparatus as set forth in claim 8 wherein the temperature sensor is located at a position remote from a surface of the polishing pad.

10. An apparatus as set forth in claim 1 wherein the container of liquid slurry contains a heating element for heating the slurry to an elevated temperature.

11. An apparatus as set forth in claim 10 further comprising a temperature sensor within the container for monitoring the temperature of the slurry, and a controller for operating the heating element in response to the temperature sensor.

12. In a wafer edge polishing apparatus, the apparatus of a type having a drum that is generally cylindric and rotatable with a polishing pad mounted thereon and forming an outermost surface around a circumference of the drum, the apparatus further having a wafer holder for positioning a peripheral edge of a wafer in engagement against the polishing pad, the improvement comprising:

a heatable mat positioned around the circumference of the drum between the drum and the polishing pad for applying heat to the polishing pad.

13. The improvement as set forth in claim 12 wherein the apparatus Is further of a type having a container of liquid chemical slurry and a slurry delivery system for delivering slurry from the container to a location where the wafer engages the pad, the improvement further comprising a heating element in the container for heating slurry to an elevated temperature.

14. A process for chemical-mechanical polishing an edge of a semiconductor wafer using a polishing pad and a liquid chemical slurry, the polishing pad having a polishing side and an underside, the process comprising the steps of:

heating the liquid slurry to an elevated temperature;

applying heat to the polishing pad from the underside of the polishing pad to elevate the temperature of the polishing pad;

engaging a peripheral edge of a semiconductor wafer against the polishing side of the polishing pad; and effecting a relative motion between the wafer and the pad while simultaneously dispensing the heated slurry generally onto a region where the edge of the wafer engages the pad, thereby polishing the edge while both the pad and the slurry are at elevated temperatures.

15. A process as set forth in claim 14 wherein the polishing pad is in the form of a cylinder and wherein said step of applying heat comprises applying heat to the underside of the polishing pad from a location internal of the cylinder.

16. A process as set forth in claim 14 further comprising the step of placing a heatable mat in close proximity with the underside of the polishing pad, and wherein the step of applying heat comprises heating the mat and thereby warming the polishing pad to an elevated temperature.

17. A process as set forth in claim 16 further comprising the steps of monitoring the temperature of the polishing pad and controlling the heatable mat in response to the monitored temperature.

18. A process as set forth in claim 16 wherein the step of placing the heatable mat in close proximity with the underside of the polishing pad comprises attaching the mat and the pad in a parallel arrangement along opposite sides of a thin metallic shell.

19. A process as set forth in claim 18 further comprising the step of positioning the pad, mat, and shell around the circumference of a rotatable, generally cylindric drum.

20. A process as set forth in claim 19 wherein the step of effecting a relative motion between the pad and the wafer comprises rotating the drum.

21. A process as set forth in claim 16 wherein the step of heating the mat comprises supplying electrical energy to the mat.

22. A process as set forth in claim 16 wherein the step of heating a liquid slurry comprises operating a heating element immersed in the slurry, monitoring the temperature of the slurry, and controlling the heating element in response to the monitored temperature.

23. A process as set forth in claim 22 further comprising the step of agitating the liquid slurry to maintain a uniform temperature.

* * * * *